US009985364B2

(12) United States Patent
Masuda et al.

(10) Patent No.: US 9,985,364 B2
(45) Date of Patent: May 29, 2018

(54) SHIELD CONNECTOR

(71) Applicant: YAZAKI CORPORATION, Tokyo (JP)

(72) Inventors: Satoki Masuda, Shizuoka (JP); Ayumu Ishikawa, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days. days.

(21) Appl. No.: 15/711,917

(22) Filed: Sep. 21, 2017

(65) Prior Publication Data

US 2018/0090857 A1 Mar. 29, 2018

(30) Foreign Application Priority Data

Sep. 26, 2016 (JP) ..... 2016-187487

(51) Int. Cl.

| | |
|---|---|
| ***H01R 9/05*** | (2006.01) |
| ***H01R 13/52*** | (2006.01) |
| ***H01R 13/6589*** | (2011.01) |
| *H01R 13/6588* | (2011.01) |

(52) U.S. Cl.

CPC ..... *H01R 9/0518* (2013.01); *H01R 13/5202* (2013.01); *H01R 13/6589* (2013.01); *H01R 13/6588* (2013.01)

(58) Field of Classification Search

CPC ..... H01R 9/0521; H01R 13/5205; H01R 9/0518; H01R 13/5202; H01R 13/6589; H01R 13/6588

USPC ..... 439/584, 607.41

See application file for complete search history.

(56) References Cited

U.S. PATENT DOCUMENTS

| | | | | |
|---|---|---|---|---|
| 9,368,902 | B2 * | 6/2016 | Nakai | H01R 13/5202 |
| 9,379,478 | B2 * | 6/2016 | Fabre | H01R 13/506 |
| 9,570,899 | B2 * | 2/2017 | Tanaka | H02G 15/007 |
| 9,620,899 | B2 * | 4/2017 | Kato | H01R 13/631 |
| 9,692,171 | B2 * | 6/2017 | Suzuki | H01R 13/5205 |
| 2009/0137153 | A1 * | 5/2009 | Yoshioka | H01R 4/185 439/607.24 |
| 2012/0100753 | A1 | 4/2012 | Omae et al. | |
| 2014/0120767 | A1 * | 5/2014 | Itsuki | H01R 13/5208 439/587 |

FOREIGN PATENT DOCUMENTS

JP 2011-119120 A 6/2011

* cited by examiner

*Primary Examiner* — Xuong Chung Trans
(74) *Attorney, Agent, or Firm* — Kenealy Vaidya LLP

(57) ABSTRACT

A shield connector includes an outer housing accommodating a shield shell in a shell insertion direction. A stepped part protrudes from an inner wall of the outer housing to support the shield shell. A cover plate portion of the shield shell includes a bendable side portion extending along the shell insertion direction. A tip imaginary line of an end face of the stepped part is curved so that a position of the end face corresponding to the joining portion is located on a far side from an electric wire pullout opening in the shell insertion direction than a position of the end face corresponding to the bendable side portion, to thereby urge the cover plate portion in a bending direction when an inner housing with the shield shell is inserted into the outer housing.

3 Claims, 15 Drawing Sheets

SHIELD CONNECTOR

CROSS REFERENCE TO RELATED APPLICATIONS

This application is based on Japanese Patent Application (No. 2016-187487) filed on Sep. 26, 2016, the contents of which are incorporated herein by way of reference.

BACKGROUND

The present invention relates to a shield connector.

A shield connector provided with terminals which use a direction intersecting with each shield electric wire as a fitting direction has been known (see Patent Literature 1 etc.). Each of these type terminals is attached to an end portion of the shield electric wire to thereby form a terminal-including electric wire. A terminal side of the terminal-including electric wire is accommodated in an inner housing. A terminal fitting portion is exposed from a terminal fitting opening of the inner housing in which the terminals have been accommodated. The shield electric wire is led out of a electric wire pullout opening of the inner housing. The inner housing in which the terminals have been accommodated is further accommodated inside an outer housing. The inner housing is inserted into the outer housing in an insertion direction following a electric wire extension direction so that the inner housing can be accommodated in the outer housing. Accordingly, the terminal fitting portion which has been accommodated in the inner housing is exposed from a housing fitting opening of the outer housing. The shield electric wire pulled out of the inner housing is led out of a electric wire pullout opening of the outer housing.

A space between the shield electric wire led out of the electric wire pullout opening of the outer housing and an inner wall of the outer housing is sealed and waterproofed by a seal material which makes tight contact with an outer circumference of the shield electric wire. For example, as shown in FIG. 13, a circumferential wall of an outer housing 501 is thin at a portion with which a mat seal 521 serving as the seal material makes tight contact. That is, an inner circumferential surface of the thin wall portion serves as a seal surface 503. On the other hand, the circumferential wall of the outer housing 501 is thick at the other portion than the seal surface 503. A plurality of ribs 507 are formed as stepped parts on the thick side in the inner surface of the outer housing 501. The ribs 507 extend along a shell insertion direction and are provided in parallel at intervals in an inner peripheral direction of the outer housing 501. That is, a shield shell 513 in which an inner housing 505 has been accommodated is supported by protruding tips 509 of the ribs 507, which protrude inward in the housing. At a electric wire pullout side end (left side end in FIG. 13) of each of the ribs 507, a surface perpendicular to the electric wire extension direction serves as an abutment surface 511 against the mat seal 521. An insertion-direction seal end surface of the mat seal 521 abuts against the abutment surface 511. In this manner, the mat seal 521 is positioned in a predetermined seal position, thereby securing waterproofness.

As shown in FIG. 14, the shield shell 513 covering the inner housing 505 has a shell body 520 which is made of a metal plate and formed into a rectangular box shape by sheet metal working. The shield shell 513 has a terminal fitting opening 518 corresponding to a terminal fitting opening of the inner housing 505, and a electric wire pullout opening 519 corresponding to a electric wire pullout opening of the inner housing 505. In addition, the shield shell 513 has a pair of cover plate portions 515 which are formed between the terminal fitting opening 518 and the electric wire pullout opening 519 and bent at bendable side portions 514 extending along the shell insertion direction. The pair of cover plate portions 515 have joining portions 516 extending along the shell insertion direction. The shield shell 513 in which the inner housing 505 has been accommodated is inserted from the electric wire pullout opening 519 into the electric wire pullout opening of the outer housing 501.

[Patent Literature 1] JP 2011-119120 A

SUMMARY

The invention has been accomplished in consideration of the aforementioned situation. An object of the invention is to provide a shield connector which can secure assembling workability of a seal shell and waterproofness of a seal material.

The foregoing object according to the invention can be achieved by the following configurations (i) to (iii).

(i) A shield connector including:

an electric wire including a shield cable and a terminal which is provided at an end of the shield cable;

an inner housing configured to accommodate the terminal;

a shield shell formed with a terminal fitting opening and an electric wire pullout opening and including a cover plate portion configured to cover the inner housing;

an outer housing including an electric wire pullout opening and configured to accommodate the shield shell in a shell insertion direction along an electric wire extension direction; and a stepped part protruding from an inner wall of the outer housing so that a protruding tip of the stepped part supports the shield shell, wherein the cover plate portion is disposed between the terminal fitting opening and the electric wire pullout opening of the shield shell, and includes a bendable side portion extending along the shell insertion direction so that a joining portion of the cover plate portion extends along the shell insertion direction, an end face of the cover plate portion in the shell insertion direction is configured to come in contact with an end face of the stepped part at a side of the electric wire pullout opening in the shell insertion direction when the inner housing is inserted into the outer housing, and a tip imaginary line of a first part of the end face of the stepped part is curved so that a position of the end face of the stepped part corresponding to the joining portion is located on a far side from the electric wire pullout opening in the shell insertion direction than a position of the end face of the stepped part corresponding to the bendable side portion, to thereby urge the cover plate portion in a bending direction when the inner housing is inserted into the outer housing.

(ii) The shield connector according to the above (i), wherein the outer housing has an inner circumferential seal surface formed in the electric wire pullout opening and configured to tightly contact with a seal outer circumferential surface of a seal material mounted on outer circumferences of the shield cable, a tip imaginary line of a second part of the end face of the stepped part is straight, so that an insertion-direction seal end surface of the seal material abuts against the second part of the end face of the stepped part, and the second part of the end face of the stepped part is disposed at both sides of the first part of the end face of the stepped part.

(iii) The shield connector according to the above (i) or (ii), wherein:

the stepped part includes a plurality of ribs extending in the shell insertion direction and provided in parallel to each other with intervals therebetween in an inner peripheral direction of the outer housing.

DETAILED DESCRIPTION OF EXEMPLIFIED EMBODIMENT

Figure 15:
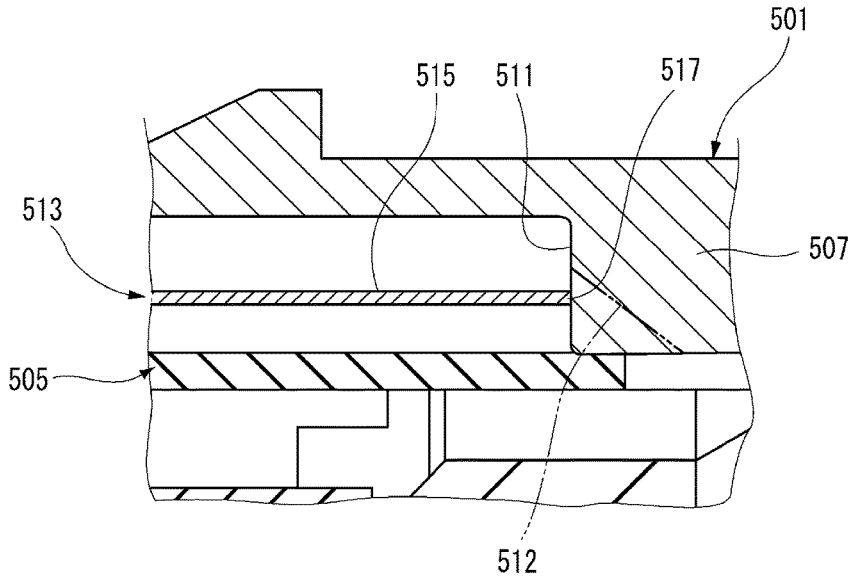
FIG. 15 is an important part enlarged sectional view showing a state in which cover plate portions of the shield shell shown in FIG. 13 have abutted.

However, the bent cover plate portions 515 may be open due to springback. In this case, when the shield shell 513 which has covered the inner housing 505 is inserted into the outer housing 501, insertion front end edges 517 of the cover plate portions 515 may be hooked by the abutment surfaces 511 of the ribs 507, as shown in FIG. 15, thereby deteriorating assembling workability. On the other hand, when fixation portions (opening prevention portions) of the cover plate portions 515 are provided in the shield shell 513, the structure becomes complicated and hinders reduction in the thickness. In addition, when tapers 512 (see an imaginary line in FIG. 15) which guide and insert the insertion front end edges 517 of the cover plate portions 515 in a bending direction are provided in the abutment surfaces 511 of the ribs 507, the abutment surfaces 511 decrease in area so much that the abutment surfaces 511 cannot support an insertion-direction seal end surface of the mat seal 521 sufficiently. Therefore, there is a fear that the mat seal 521 may be displaced, thereby deteriorating waterproofness.

The invention has been accomplished in consideration of the aforementioned situation. An object of the invention is to provide a shield connector which can secure assembling workability of a seal shell and waterproofness of a seal material.

An embodiment according to the invention will be described below with reference to the drawings.

Figure 1:
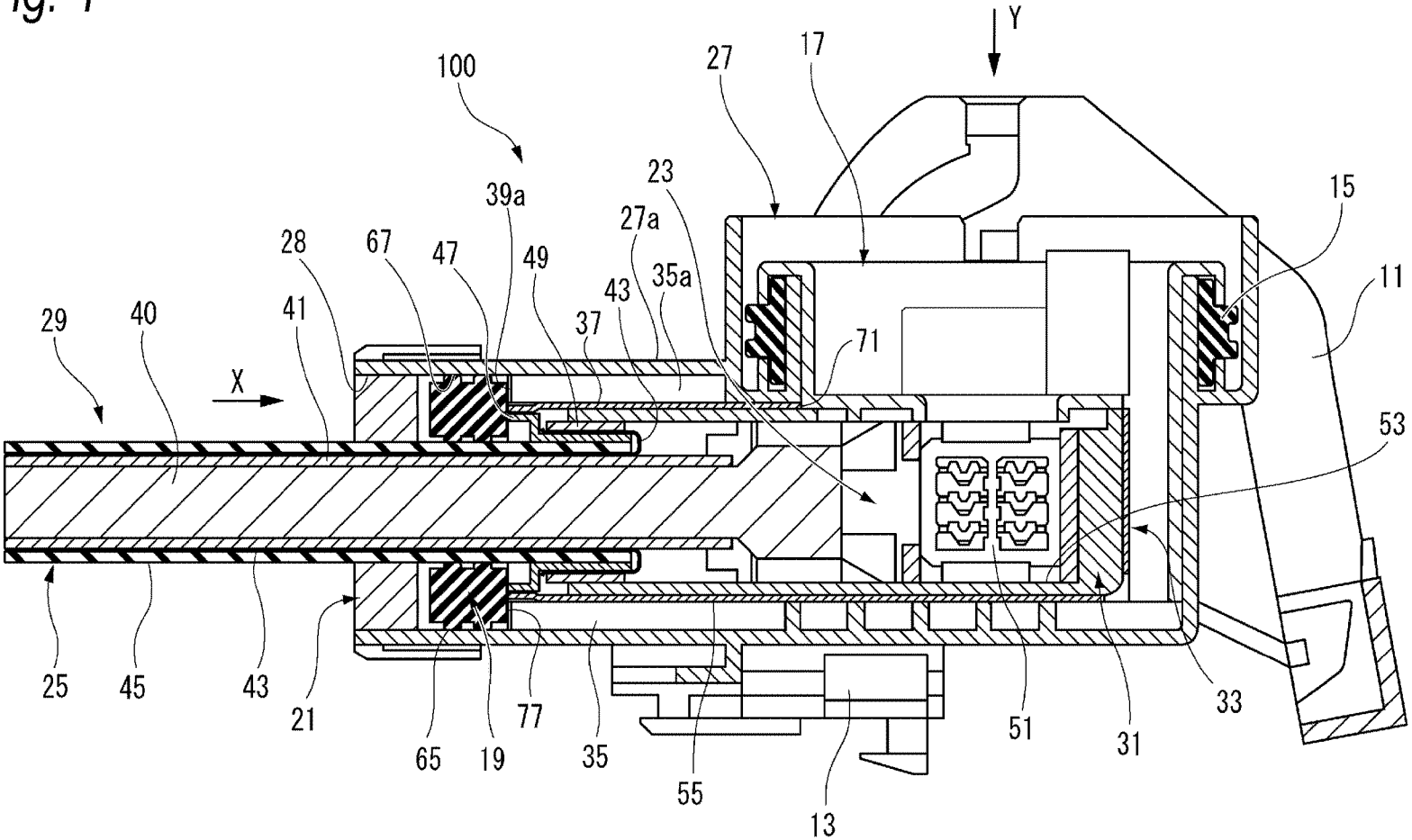
FIG. 1 is a sectional view taken along a direction following a fitting direction between a shield electric wire and a terminal in a shield connector according to an embodiment of the invention.

FIG. 1 is a sectional view taken along a direction following a fitting direction between a shield electric wire and a terminal in a shield connector 100 according to the embodiment of the invention.

The shield connector 100 according to the embodiment is a lever fitting type female connector in which terminals 23 serving as female terminals are accommodated. As a basic configuration, the shield connector 100 according to the embodiment is provided with terminal-including electric wires 29, an inner housing 31, a shield shell 33, an outer housing 27, and a mat seal 19. The mat seal 19 is a seal material.

Figure 2:
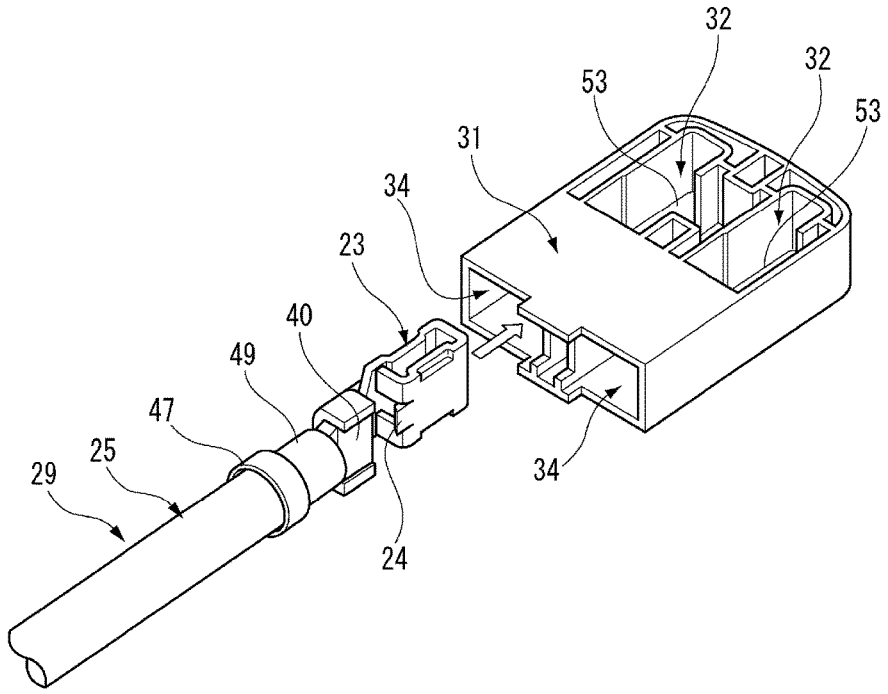
FIG. 2 is a perspective view of an inner housing and a terminal-including electric wire shown in FIG. 1.

As shown in FIG. 1 and FIG. 2, in each of the terminal-including electric wires 29, the terminal 23 is attached to a terminal end of the shield cable 25. The shield cable 25 is configured as a coaxial electric wire including a core wire 40, an internal coating 41, an electrically conductive braid 43, and an external sheath 45 which are disposed sequentially from the center. The internal coating 41 covers the core wire 40. The braid 43 covers the internal coating 41. The external sheath 45 covers the braid 43.

The external sheath 45 at the terminal end of the shield electric wire 25 is cut by a predetermined length. The braid 43 exposed thus is folded back toward an opposite side to the terminal end and onto an outer circumference of the external sheath 45. The internal coating 41 exposed thus is cut by a predetermined length. The internal coating 41 is removed from the shield cable 25. Thus, the core wire 40 is exposed. The terminal 23 is electrically conductively connected to the exposed core wire. An electrically conductive shield terminal 47 is outer-fitted to the braid 43 which has been folded back on the external sheath 45 of the shield cable 25. The shield terminal 47 is electrically conductively fixed to the braid 43 by a shield sleeve 49 crimped on an external circumference of the shield terminal 47. Thus, the shield cable 25 becomes the terminal-including electric wire 29 in which the terminal 23 and the shield terminal 47 have been attached.

In the embodiment, the terminal 23 is made of a sheet metal material and formed into a rectangular box shape. In the terminal 23, one side surface of the box shape is opened. The opening of the terminal 23 serves as a fitting portion to a counterpart terminal (not shown). That is, the terminal 23 is formed as a female terminal. Incidentally, the terminal in the invention may be a male terminal alternatively.

As to the terminal-including electric wire 29, a direction intersecting with the shield cable 25 corresponds to a fitting direction of the terminal 23 (a direction of an arrow Y). The terminal 23 internally retains a terminal spring 51 which enhances electric conductivity to the counterpart terminal (see FIG. 1).

As shown in FIG. 1 and FIG. 2, the inner housing 31 is made of an insulating resin and shape like a rectangular box. In the embodiment, the inner housing 31 has a pair of terminal accommodating chambers 53. That is, the terminal sides of the pair of terminal-including electric wires 29 are accommodated in the inner housing 31. The fitting portions of the terminals 23 are exposed from terminal fitting openings 32 of the inner housing 31 where the terminals 23 have been accommodated. The shield electric wires 25 are led out of electric wire pullout openings 34 of the inner housing 31. Lock protrusions 24 are locked by flexible lock portions (not shown) formed protrusively in the terminal accommodating chambers 53 so that the terminals 23 accommodated in the inner housing 31 can be restricted from being detached from the inner housing 31.

Figure 3:
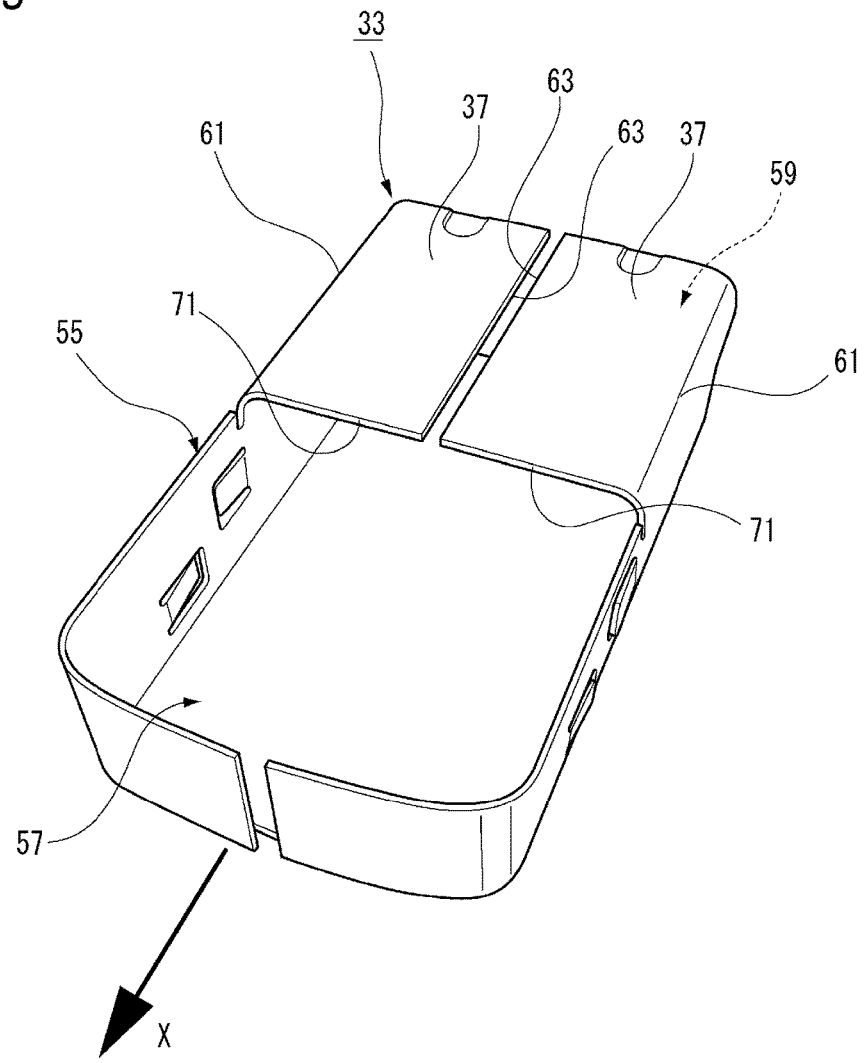
FIG. 3 is an overall perspective view of a shield shell shown in FIG. 1.

FIG. 3 is an overall perspective view of the shield shell 33.

The shield shell 33 has a shell body 55 which is made of an electrically conductive metal plate and formed into a rectangular box shape by sheet metal working. The shield shell 33 has a terminal fitting opening 57 and an electric wire pullout opening 59. The shield shell 33 covers the inner housing 31. The terminal fitting opening 57 exposes the fitting portions of the pair of terminals 23. The counterpart terminals are fitted into the terminals 23 exposed in the terminal fitting opening 57. The shield cables 25 pulled out of the electric wire pullout openings 34 of the inner housing 31 are led out of the electric wire pullout opening 59.

In the shield shell 33, a pair of cover plate portions 37 are formed between the terminal fitting opening 57 and the electric wire pullout opening 59. In the embodiment, the cover plate portions 37 are bent respectively at bendable side portions 61 extending along a shell insertion direction (a direction of an arrow X), and a pair of joining portions 63 on an opposite side to the bendable side portions 61 extend in the shell insertion direction. That is, the pair of the cover plate portions 37 are configured to be opened like hinged double doors.

Incidentally, the cover plate portions 37 may be formed, for example, replaced by a single cover plate portion 37. In this case, in the cover plate portion 37, a joining portion 63 is formed on an opposite side to a bendable side portion 61 so that the joining portion 63 can be joined to a joining portion 63 formed at an upper end edge of the shell body 55.

The cover plate portions 37 may be bent after the inner housing 31 has been accommodated in the shield shell 33. In addition, the inner housing 31 may be inserted into the shield shell 33 from the electric wire pullout opening 59 in a state in which the cover plate portions 37 have been bent in advance. In any case, the joining portions 63 of the cover plate portions 37 are not fixed by a lock structure or by welding. Thus, the shield shell 33 can be manufactured compactly and easily so that the size and component cost of the shield shell 33 can be reduced.

Figure 4:
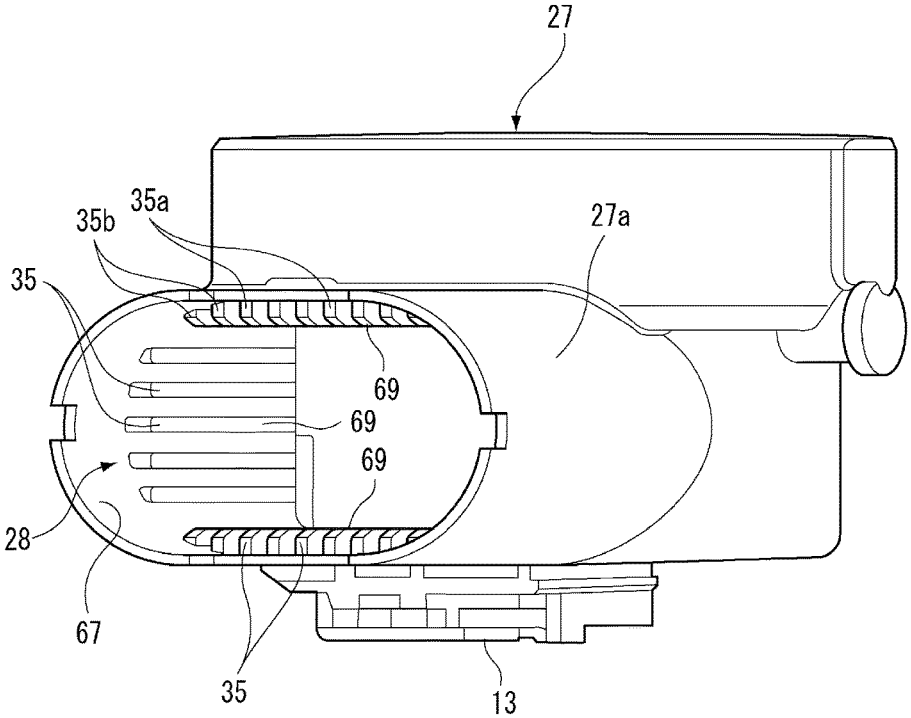
FIG. 4 is a perspective view of an outer housing shown in FIG. 1, as seen from a electric wire pullout opening side.

FIG. 4 is a perspective view of the outer housing 27, as seen from a electric wire pullout opening 28 side.

A cylinder portion 27*a* of the outer housing 27 has the electric wire pullout opening 28 which accommodates the shield shell 33 out of which the shield cables 25 have been led, in the shell insertion direction X following a electric wire extension direction. The shield cables 25 are led out of the electric wire lead-out opening 28 of the outer housing 27 in which the inner housing 31 has been accommodated.

An inner circumferential seal surface 67 is formed in the electric wire pullout opening portion 28 of the outer housing 27 so as to make tight contact with a seal outer circumferential surface 65 (see FIG. 1) of the mat seal 19 mounted on outer circumferences of the shield cables 25.

The mat seal 19 is made of an elastic material such as rubber. An inner circumference of the mat seal 19 makes tight contact with the outer circumferences of the shield cables 25. The seal outer circumferential surface 65 of the mat seal 19 makes tight contact with the inner circumferential seal surface 67 of the outer housing 27. Thus, the mat seal 19 seals and water-proofs a space between the shield cables 25 and the cylinder portion 27*a* of the outer housing 27. Consequently, water tightness between the shield cables 25 and the cylinder portion 27*a* of the outer housing 27 can be secured.

Ribs 35 are provided on an inner wall of the cylinder portion 27*a* in the outer housing 27. The ribs 35 protrude from the inner wall to form stepped parts in which protruding tips 69 of the ribs 35 support the shield shell 33. The ribs 35 are formed on a far side in the shell insertion direction X than the aforementioned inner circumferential shell surface 67.

The stepped parts in the embodiment correspond to the ribs 35 which extend in the shell insertion direction X and are provided in parallel at intervals in an inner peripheral direction of the cylinder portion 27*a* in the outer housing 27. In each of the ribs 35, the protruding tip 69 protruding inward in the housing supports the shield shell 33 where the inner housing 31 has been accommodated. In addition, the rib 35 is formed, for example, into a square shape in section perpendicular to the extension direction. In the embodiment, all the ribs 35 have the same sectional shape. Incidentally, the ribs 35 may have different sectional shapes used in mixture. In addition, the stepped parts according to the invention may be formed, for example, as a thick portion of the cylinder portion 27*a* formed on the far side in the shell insertion direction X than the inner circumferential seal surface 67 when, for example, the inner circumferential seal surface 67 is used as a thin portion of the cylinder portion 27*a* in the outer housing 27. In this case, the inner circumferential surface of the cylinder portion 27*a* in the stepped parts is a continuous inner surface (cylinder inner surface).

Figure 5:
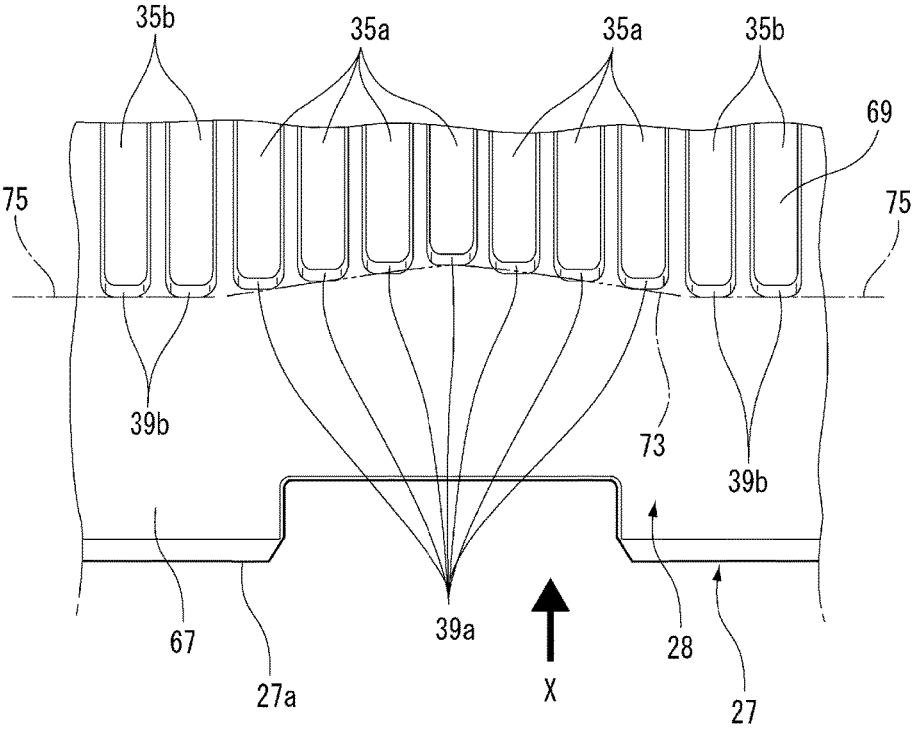
FIG. 5 is an important part enlarged view of stepped parts formed in an inner wall of the outer housing.

FIG. 5 is an important part enlarged view of some of the ribs formed on the inner wall of the outer housing 27.

In the embodiment, of the ribs 35 which are provided in parallel at the intervals in the inner peripheral direction of the inner circumferential surface in the cylinder portion 27*a*, a plurality of ribs 35*a* formed in positions (upper inner surface in FIG. 4) corresponding to the cover plate portions 37 of the shield shell 33 have electric wire pullout side end surfaces 39*a*. Distances between an opening end of the cylinder portion 27*a* and the electric wire pullout side end surfaces 39*a* are gradually farther toward the center.

That is, as shown in FIG. 5, a tip imaginary line 73 passing through the electric wire pullout side end surfaces 39*a* of the ribs 35*a* is curved so that positions corresponding to the joining portions 63 of the cover plate portions 37 can be located on the far side in the shell insertion direction X. The electric wire pullout side end surfaces 39*a* in the ribs 35*a* stepwise abut against insertion front end edges 71 of the cover plate portions 37 when the shield shell 33 is inserted. The cover plate portions 37 stepwise abut against the electric wire pullout side end surfaces 39*a* of the corresponding ribs 35*a*. As a result, the cover plate portions 37 are urged in the bending direction.

In other words, the tip imaginary line 73 of a first part of the end face 39*a* of the stepped part 35*a* is curved so that a position of the end face 39*a* of the stepped part 35*a* corresponding to the joining portion 63 is located on a far side from the electric wire pullout opening 28 in the shell insertion direction X than a position of the end face 39*a* of the stepped part 35*a* corresponding to the bendable side portion 61, to thereby urge the cover plate portion 37 in a bending direction when the inner housing 31 is inserted into the outer housing 27.

In the embodiment, insertion start ends (the electric wire pullout side ends) of the ribs 35 in the shell insertion direction, including the ribs 35*a*, are chamfered so that the shield shell 33 can be inserted into the cylinder portion 27*a* of the outer housing 27 easily. That is, the ribs 35*a* can easily pick up the upward slanting cover plate portions 37 (easily hold down the cover plate portions 37 in the bending direction).

Accordingly, in the shield shell 33, manufacturing tolerance in the hinged double doors of the cover plate portions 37 can be set in an opening direction. As a result, working management can be made easy and working cost can be made inexpensive. In addition, the shield shell 33 can be prevented from being hooked during insertion of the inner housing 31. Thus, assembling workability can be enhanced.

In addition, ribs 35*b* are formed on opposite sides sandwiching the ribs 35*a* (see FIG. 5). The ribs 35*b* are provided with electric wire pullout side end surfaces 39*b* at the electric wire pullout side ends. A straight tip imaginary line 75 passes through the electric wire pullout side end surfaces 39*b*. The ribs 35*a* have the electric wire pullout side end surfaces 39*a* through which the tip imaginary line 73 passes. An insertion-direction seal end surface 77 (see FIG. 1) of the mat seal 19 abuts against the electric wire pullout side end surfaces 39*b*.

Further, the shield connector 100 according to the embodiment is provided with a lever 11, a fitting position assuring lock 13 (CPA: Connector Position Assurance), a connector packing 15, a front holder 17 and a rear holder 21.

The lever 11 uses the principle of lever to make it possible to attain fitting between the shield connector 100 and a counterpart connector (not shown) by low insertion force. The fitting position assuring lock 13 has a half-fitting preventing function. The fitting position assuring lock 13 is provided for preventing the shield connector 100 and the counterpart connector from being unlocked for some reason in a state in which the shield connector 100 and the counterpart connector have been fitted to each other. For example, the fitting position assuring lock 13 is configured to cover the locking part between the shield connector 100 and the counterpart connector so as to prevent the locking part from being unlocked. The connector packing 15 is a seal material which secures water tightness between the shield connector 100 and the counterpart connector during fitting between the connectors.

The front holder 17 is mounted in a housing fitting opening of the outer housing 27 to cover the vicinities of the fitting portions of the terminals 23 which have been accommodated in the shield connector 100. The connector packing 15 is retained thus. The rear holder 21 is mounted in the electric wire pullout opening 28 of the outer housing 27 to thereby restrict the mat seal 19 from being detached.

Figure 6A:
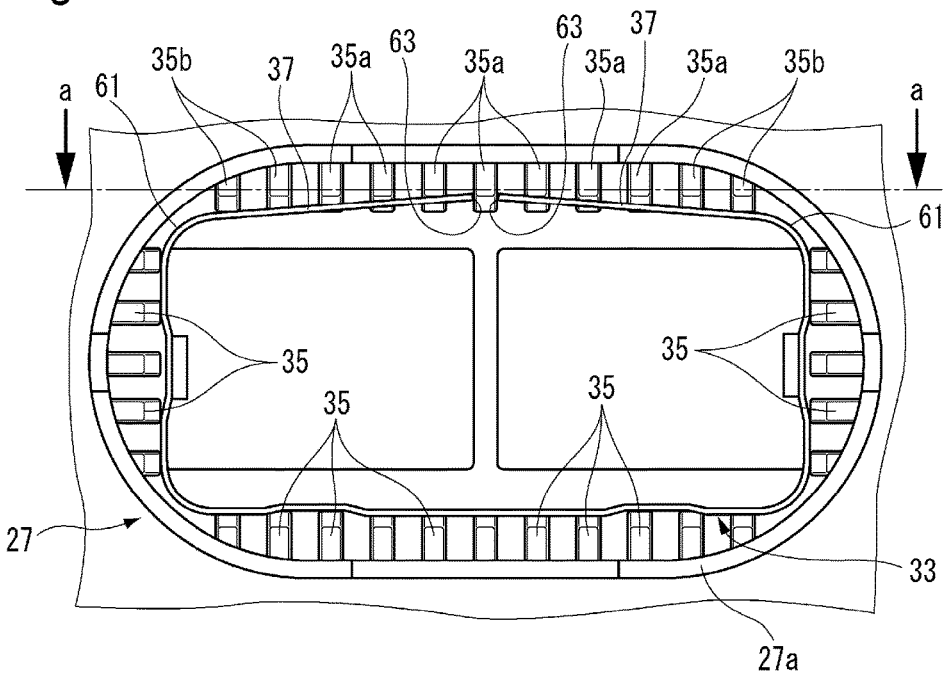
FIG. 6A is a back view of the outer housing in which the seal shell has not been inserted into the stepped parts.
Figure 6B:
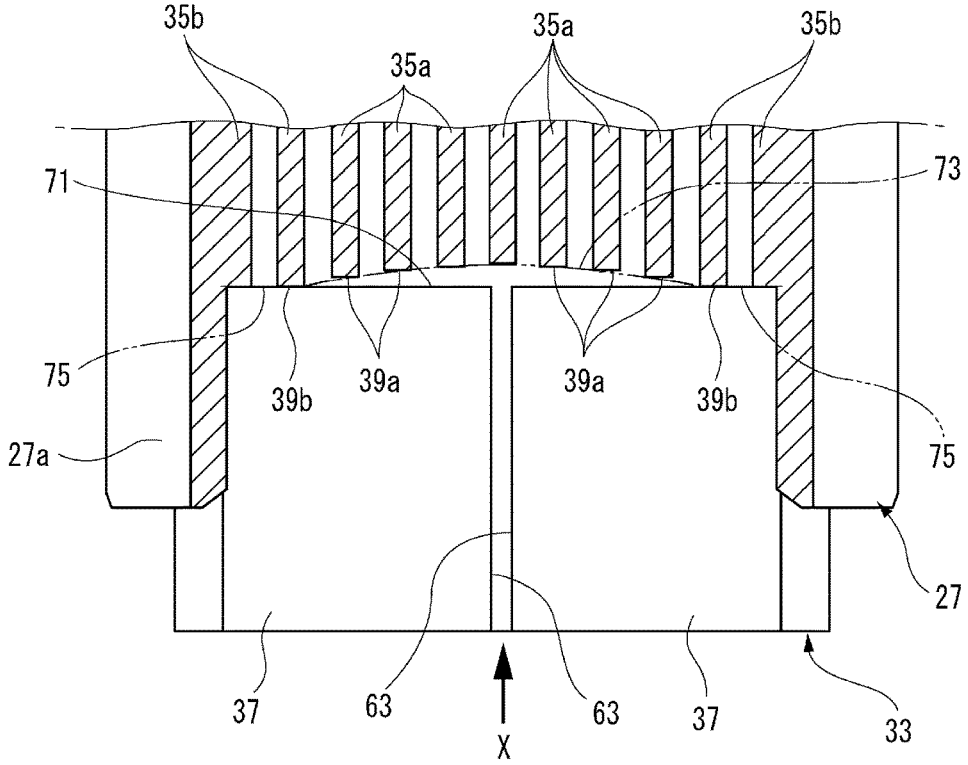
FIG. 6B is a sectional view taken along a line a-a of FIG. 6A.

As shown in FIGS. 6A and 6B, the pair of the cover plate portions 37 of the shield connector 100 may be a little open (in a state in which the joining portions 63 slant upward to the outside) during insertion of the shield shell 33. In this case, when the insertion of the shield shell 33 is started, the electric wire pullout side end surfaces 39*a* of the ribs 35*a* on the opposite sides located on the tip imaginary line 73 abut against the insertion front end edges 71 of the cover plate portions 37. When the shield shell 33 is further inserted, the cover plate portions 37 receive reaction force from the electric wire pullout side end surfaces 39*a* to be urged in the bending direction. Thus, the original upward slanting of the cover plate portions 37 can be reduced.

Figure 7A:
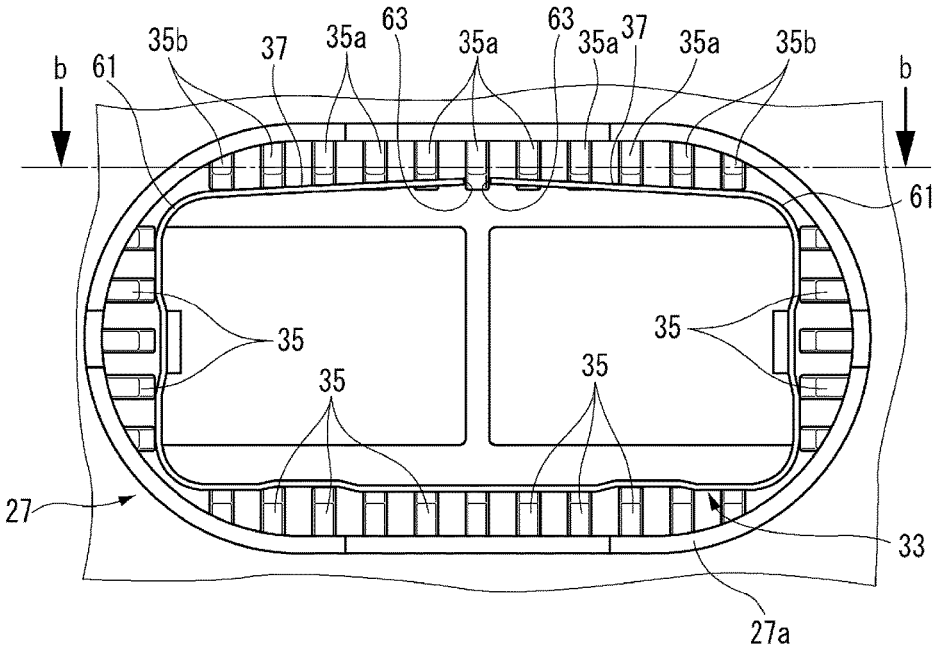
FIG. 7A is a back view of the outer housing in which the seal shell is in the middle of insertion into the stepped parts.
Figure 7B:
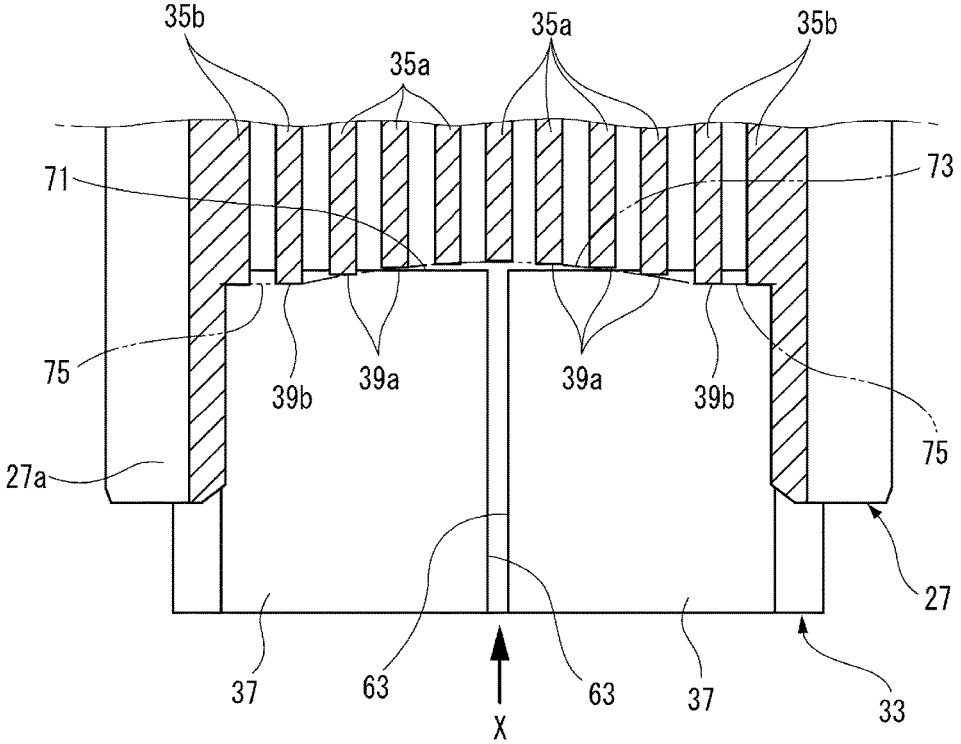
FIG. 7B is a sectional view taken along a line b-b of FIG. 7A.

As shown in FIGS. 7A and 7B, in the middle of the insertion of the shield shell 33, the insertion front end edges 71 of the cover plate portions 37 slanting upward by a smaller amount than the original upward slanting amount abut against the electric wire pullout side end surfaces 39*a* of the ribs 35*a* on the center side relatively to the ribs 35*a* on the opposite sides on the tip imaginary line 73. When the shield shell 33 is further inserted, the cover plate portions 37 receive reaction force from the electric wire pullout side end surfaces 39*a* on the center side to be further urged in the bending direction. Thus, the upward slanting amount of each of the cover plate portions 37 is further suppressed.

Figure 8A:
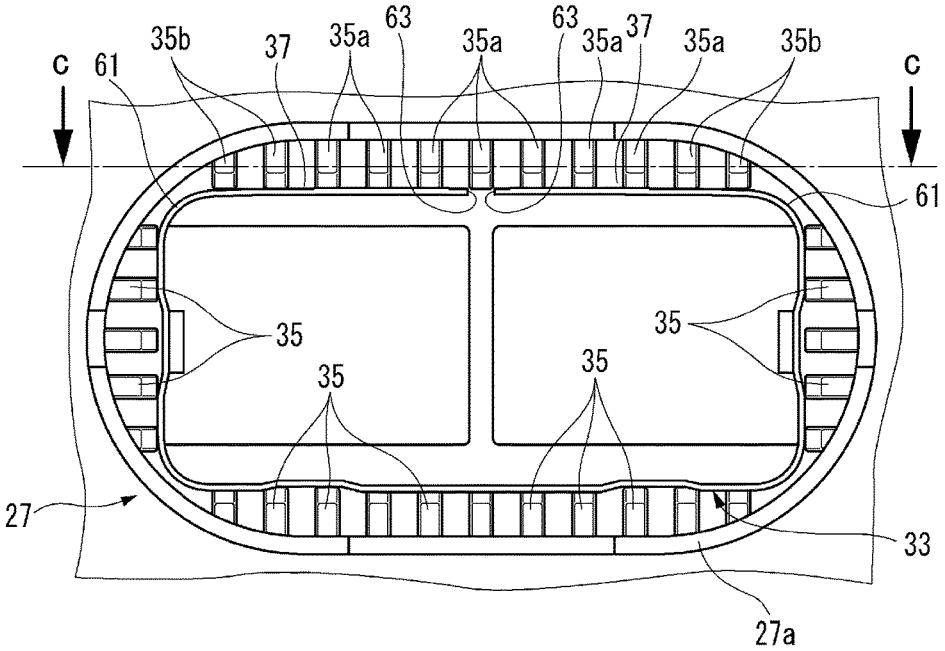
FIG. 8A is a back view of the outer housing in which the insertion of the seal shell into the stepped parts has been completed.
Figure 8B:
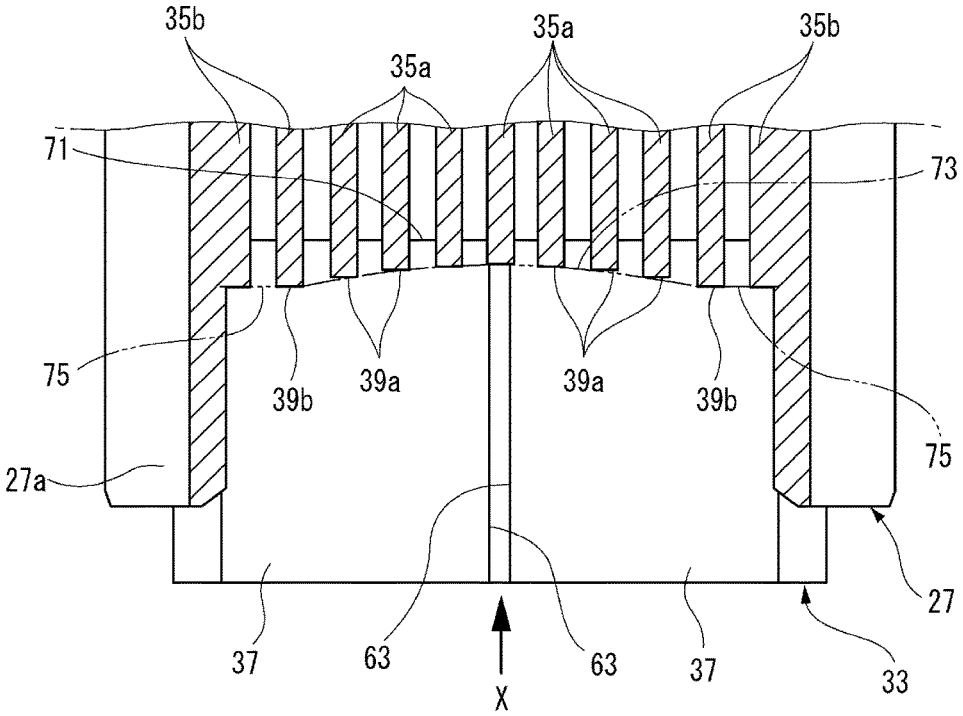
FIG. 8B is a sectional view taken along a line c-c of FIG. 8A.

As shown in FIGS. 8A and 8B, when the insertion of the shield shell 33 into a region where the ribs 35 on the inner circumferential surface of the cylinder portion 27*a* are provided protrusively is completed, the insertion front end edges 71 of the cover plate portions 37 abut against the electric wire pullout side end surfaces 39*a* of the ribs 35*a* on the center side on the tip imaginary line 73. Therefore, the shield shell 33 is held down by the electric wire pullout side end surfaces 39*a* of the ribs 35*a* on the center side to thereby bring the cover plate portions 37 into a closed state. As a result, the shield shell 33 is inserted up to a fixed position of the outer housing 27.

In this manner, in the shield connector 100, the positions (positions along the shell insertion direction X) of the electric wire pullout side end surfaces 39*a* of the ribs 35*a* provided on the outer housing 27 change to stepwise abut against the insertion front end edges 71 of the cover plate portions 37 respectively in accordance with a state of progress in assembling the shield shell 33.

Next, effects of the aforementioned configuration will be described.

In the shield connector 100 according to the embodiment, insertion workability of the shield shell 33 into the outer housing 27 can be prevented from deteriorating even when there is a variation in the bending degree of the cover plate portions 37.

Figure 9B:
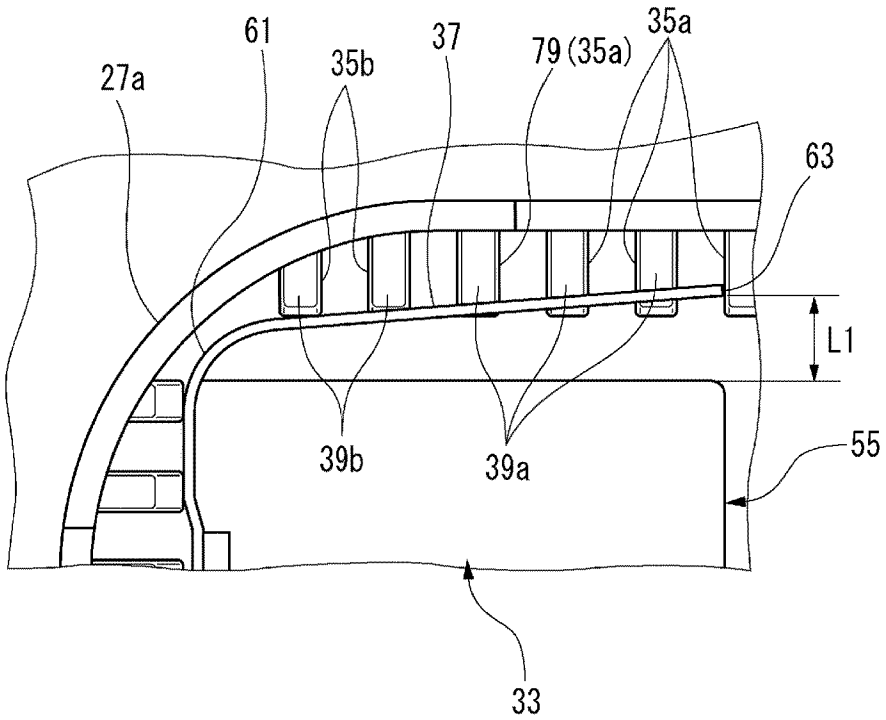
FIG. 9B is a back view of FIG. 9A as seen from a shell insertion direction.
Figure 9A:
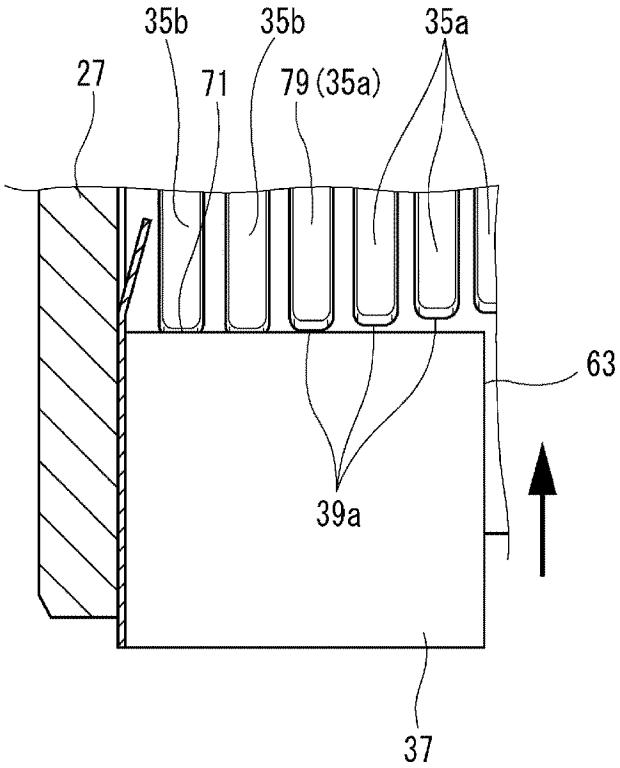
FIG. 9A is an important part plan view showing a situation that a cover plate portion has abutted against electric wire pullout side end faces immediately after the shield shell is inserted.

That is, as shown in FIGS. 9A and 9B, when the bending amount in each of the pair of cover plate portions 37 is insufficient, the pair of cover plate portions 37 is open in a truncated chevron shape in which the joining portions 63 slant upward (see FIG. 6A). When the shield shell 33 which has accommodated the inner housing 31 is inserted into the outer housing 27 in this state, each of base end sides of the cover plate portions 37 small in the open amount (upward slanting amount) in the vicinities of the bendable side portions 61 first abuts against one (first rib 79) of the ribs 35*a* close to the bendable side portion 61.

When the shield shell 33 is further inserted into the outer housing 27, the insertion front end edge 71 of the cover plate portion 37 accommodates reaction force (urging force) from the electric wire pullout side end surface 39*a* of the first rib 79 so that the cover plate portion 37 can be bent in the bending direction. Thus, the joining portion 63 is held down to an upward slanting position at a distance L1 from the shell body 55.

Figure 10B:
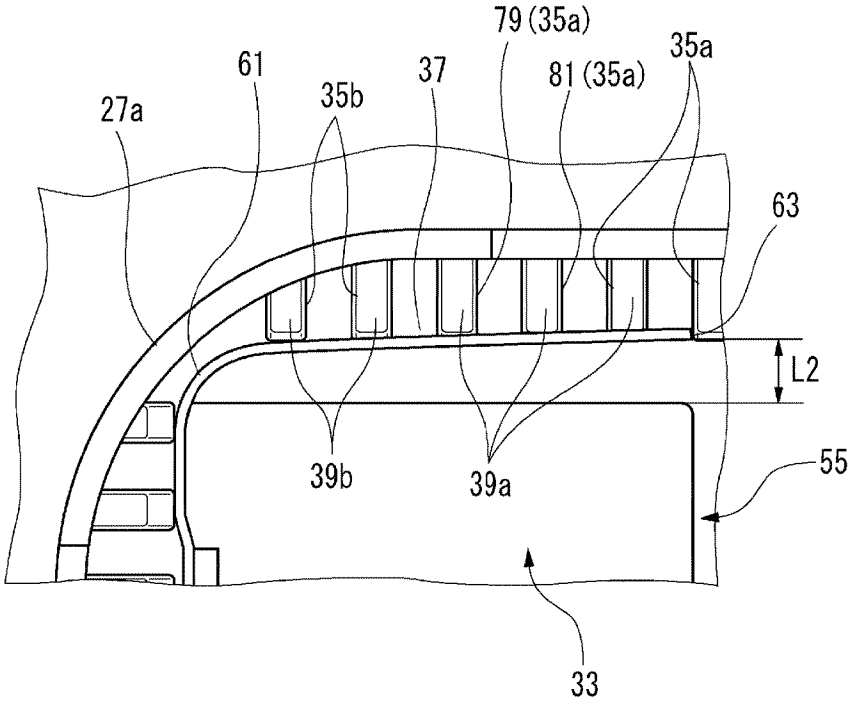
FIG. 10B is a back view of FIG. 10A as seen from the shell insertion direction.
Figure 10A:
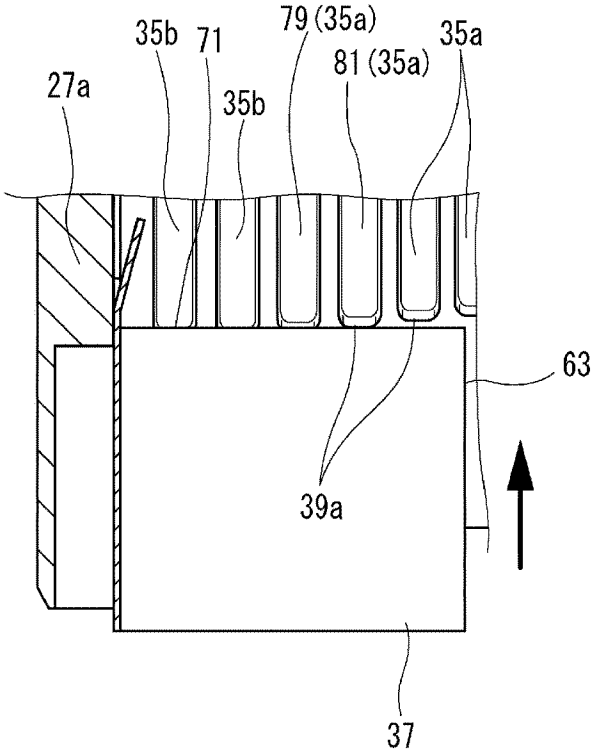
FIG. 10A is an important part plan view showing a situation that the cover plate portion has abutted against the electric wire pullout side end faces after the shield shell is further inserted.

When the shield shell 33 is further inserted, the insertion front end edge 71 of the cover plate portion 37 accommodates reaction force (urging force) from the electric wire lead-out side end surface 39*a* of a second rib 81 adjacent to the joining portion 63 side of the first rib 79 so that the cover plate portion 37 can be bent in the bending direction, as shown in FIGS. 10A and 10B. Thus, the joining portion 63 is held down to an upward slanting position at a distance L2 from the shield body 55.

The respective positions of the electric wire pullout side end surfaces 39*a* of the ribs 35*a* are gradually located far toward the joining portion 63. Therefore, whenever the shield shell 33 is inserted into the cylinder portion 27*a*, the cover plate portion 37 stepwise abuts against a next rib 35*a* disposed on a far side.

Figure 11B:
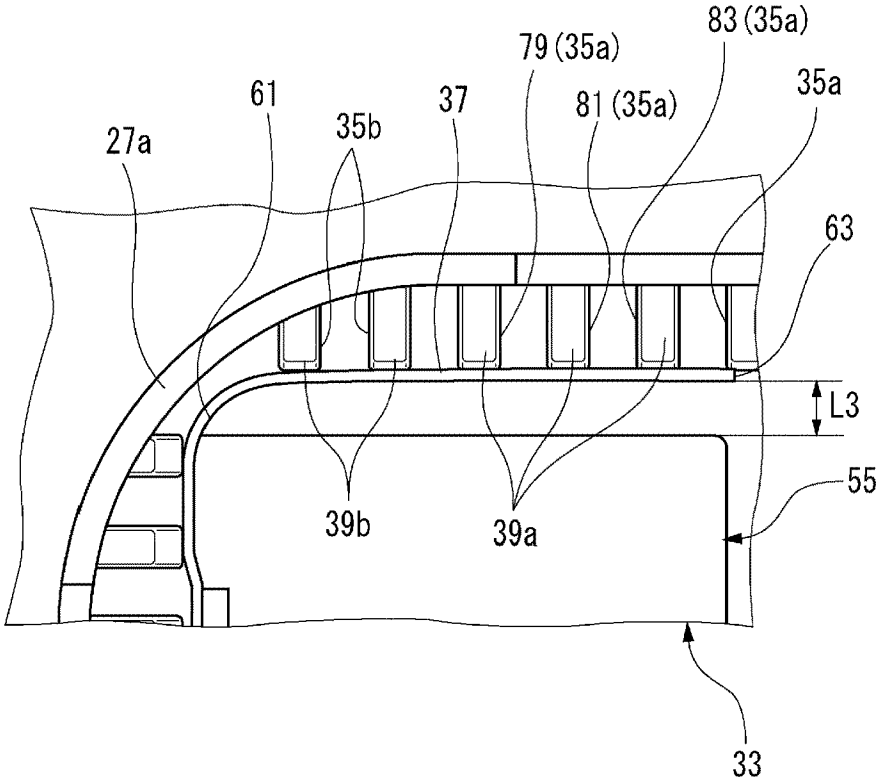
FIG. 11B is a back view of FIG. 11A as seen from the shell insertion direction.
Figure 11A:
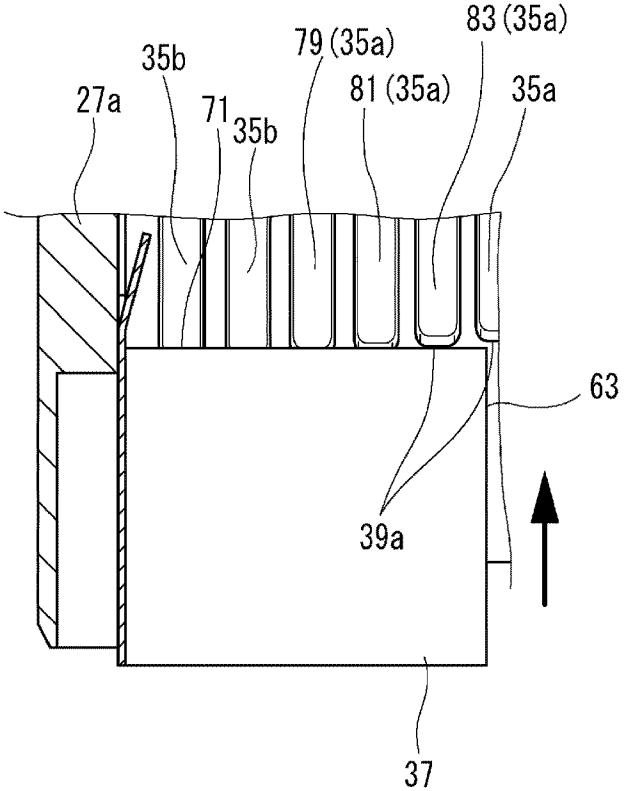
FIG. 11A is an important part plan view showing a situation that the cover plate portion has abutted against the electric wire pullout side end faces after the shield shell is further inserted.

When the shield shell 33 is further inserted, the insertion front end edge 71 accommodates reaction force (urging force) from the electric wire pullout side end surface 39*a* of a third rib 83 adjacent to the joining portion 63 side of the second rib 81 so that the cover plate portion 37 can be bent in the bending direction, as shown in FIGS. 11A and 11B. Thus, the joining portion 63 is held down to an upward slanting position at a distance L3 from the shell body 55.

Figure 12B:
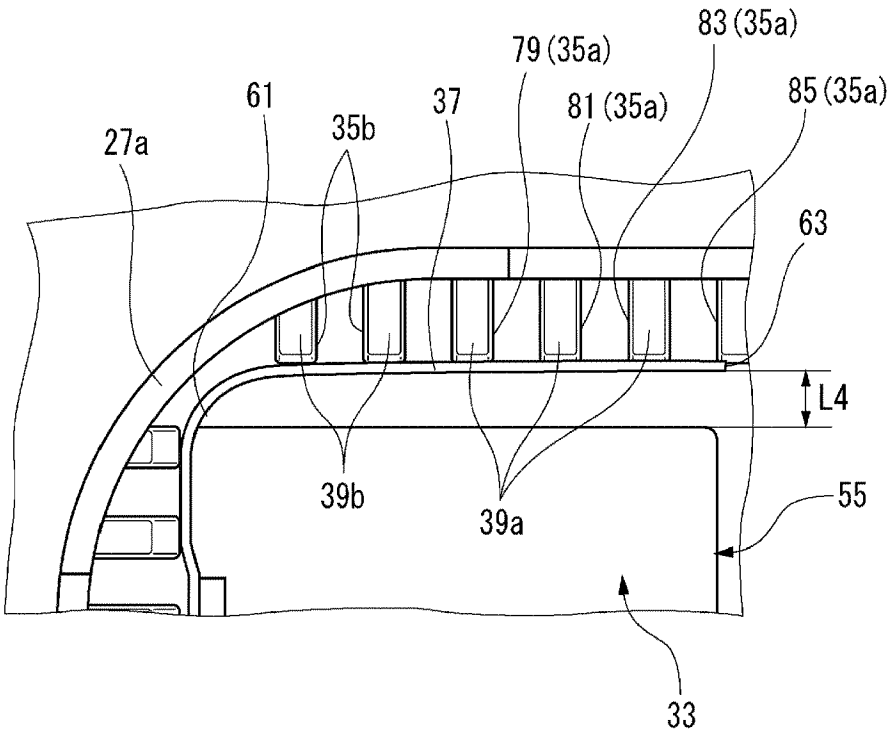
FIG. 12B is a back view of FIG. 12A as seen from the shell insertion direction.
Figure 12A:
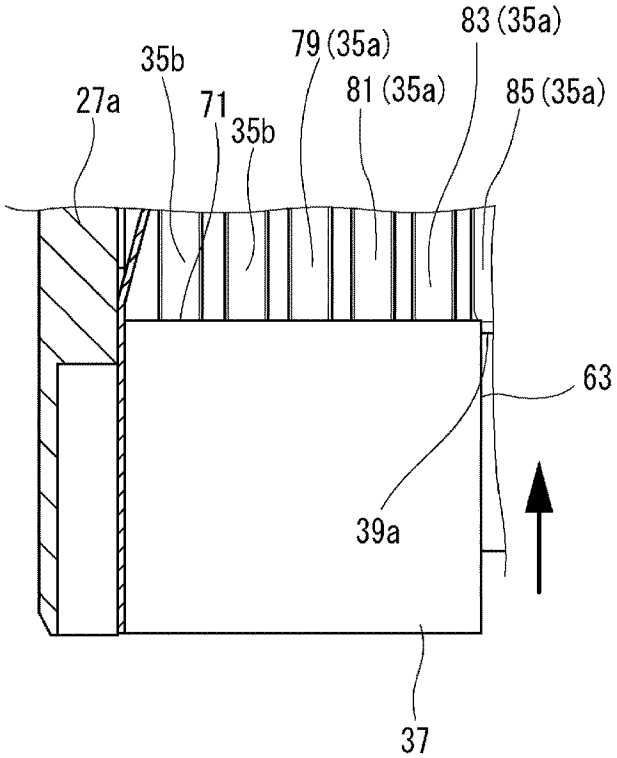
FIG. 12A is an important part plan view showing a situation that the cover plate portion has abutted against the electric wire pullout side end faces after the shield shell is further inserted.
Figure 13:
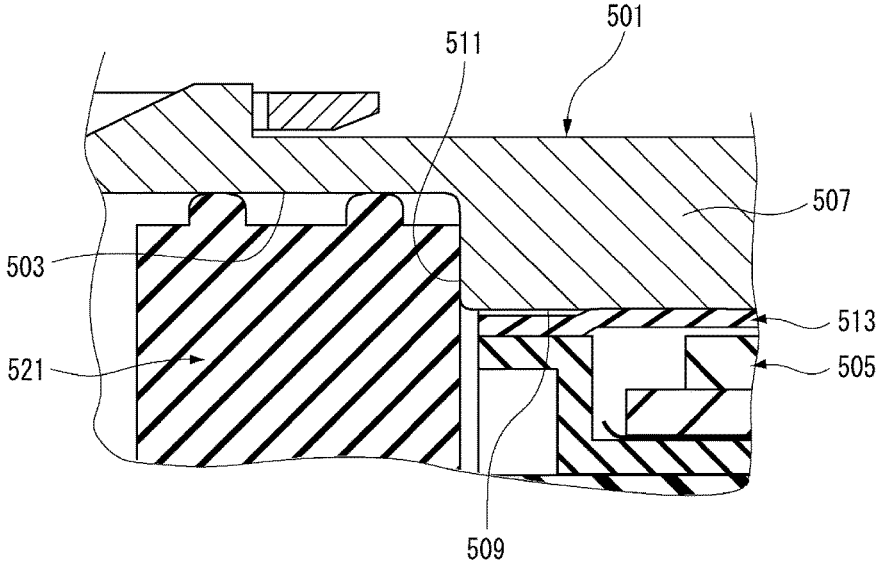
FIG. 13 is an important part enlarged sectional view showing stepped parts of an outer housing in a background-art shield connector.
Figure 14:
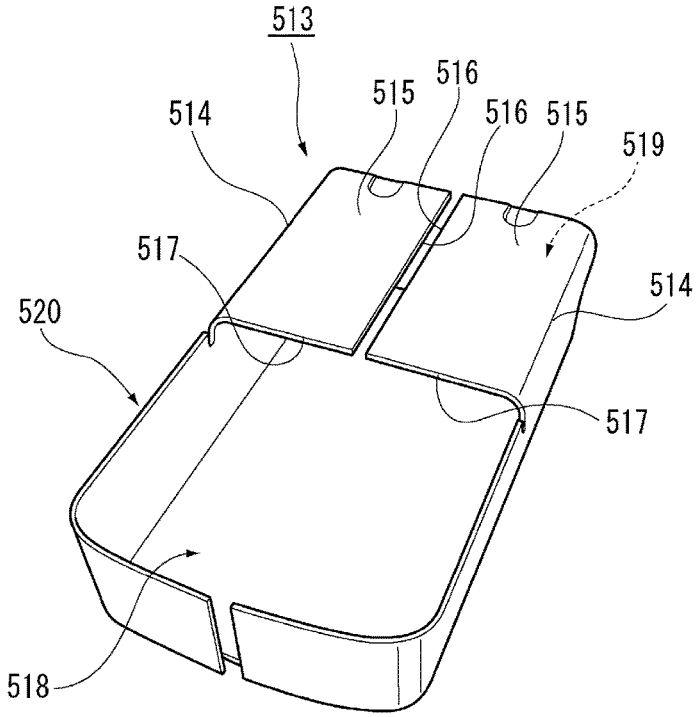
FIG. 14 is an overall perspective view of a shield shell shown in FIG. 13.

Accordingly, the cover plate portion 37 is bent stepwise so that the insertion front end edge 71 at the joining portion 63 can be finally bent by the electric wire pullout side end surface 39*a* of a fourth rib 85 adjacent to the joining portion 63 side of the third rib 83, as shown in FIGS. 12A and 12B. Thus, the joining portion 63 is held down to an upward slanting position at a distance L4 from the shell body 55. The distance L4 is a bending position in which the cover plate portion 37 does not interfere with the electric wire pullout side end surface 39*a* of the rib 35*a* to deteriorate assembling workability. As a result, the insertion front end edge 71 at the joining portion 63 with a large open amount is not directly hooked by the rib 35*a*. Therefore, the shield shell 33 can be inserted smoothly into the cylinder portion 27*a* of the outer housing 27.

Further, in the shield connector 100 according to the embodiment, assembling workability of the shield shell 33 and waterproofness of the mat seal 19 can be secured only if the height of each rib 35 or a curvature of the tip imaginary line 73 passing through the electric wire pullout side end surfaces 39*a* is changed. In addition, even when there is a variation in the shape of the mat seal 19 or the opening degree between the joining portions 63 depending on specifications of the shield shell 33, the shield connector 100 can support the variation only if the ribs 35*a* are modified. Thus, the shield connector 100 has high general-purpose properties.

In addition, in the shield connector 100 according to the embodiment, a space between each of the shield cables 25 led out of the outer housing 27 and the inner circumferential seal surface 67 in the electric wire pullout opening 28 of the outer housing 27 is sealed and water-proofed by the mat seal 19. On this occasion, the insertion-direction seal end surface 77 of the mat seal 19 cannot make contact with the electric wire pullout side end surfaces 39*a* which are located on the far side and formed in the ribs 35*a* along which the tip imaginary line 73 is curved. However, the insertion-direction seal end surface 77 of the mat seal 19 can make contact with the electric wire pullout side end surfaces 39*b* of the ribs 35*b* along which the tip imaginary line 75 is straight. Thus, the mat seal 19 can be surely positioned and pressed in the shell insertion direction X, thereby preventing deterioration in waterproof performance.

Further, in the shield connector 100 according to the embodiment, due to a gap present between adjacent ones of the ribs 35, a contact area between the outer housing 27 and the shield shell 33 when the shield shell 33 is inserted can be made smaller than that in the case where a stepped part is formed in a thick portion. Thus, insertion resistance can be suppressed so that insertion workability of the shield shell 33 can be further enhanced. In addition, the resin material for forming the outer housing 27 can be reduced. Thus, the outer housing 27 can be lighter in weight.

Accordingly, according to the shield connector 100 according to the embodiment, assembling workability of the shield shell 33 and waterproofness of the mat seal 19 can be secured.

Incidentally, the invention is not limited to the aforementioned embodiment. Any modification, improvement, etc. can be made on the invention suitably. In addition thereto, the materials, shapes, dimensions, numbers, arrangement places, etc. of the respective constituent elements in the aforementioned embodiment are not limited but can be changed desirably as long as they can achieve the invention.

Here, the aforementioned features of the embodiment of the shield connector according to the invention will be summarized and described briefly in the following items (i) to (iii) respectively.

(i) A shield connector (100) comprising:

an electric wire (29) including a shield cable (25) and a terminal (23) which is provided at an end of the shield cable (25);

an inner housing (31) configured to accommodate the terminal (23);

a shield shell (33) formed with a terminal fitting opening (57) and an electric wire pullout opening (59) and including a cover plate portion (37) configured to cover the inner housing (31);

an outer housing (27) including an electric wire pullout opening (28) and configured to accommodate the shield shell (33) in a shell insertion direction (X) along an electric wire extension direction; and a stepped part (35, 35*a*, 35*b*) protruding from an inner wall of the outer housing (27) so that a protruding tip of the stepped part (35, 35*a*, 35*b*) supports the shield shell (33), wherein the cover plate portion (37) is disposed between the terminal fitting opening (57) and the electric wire pullout opening (59) of the shield shell (33), and includes a bendable side portion (61) extending along the shell insertion direction (X) so that a joining portion (63) of the cover plate portion (37) extends along the shell insertion direction (X), an end face (71) of the cover plate portion (37) in the shell insertion direction (X) is configured to come in contact with an end face (39*a*) of the stepped part (35*a*) at a side of the electric wire pullout opening (28) in the shell insertion direction (X) when the inner housing (31) is inserted into the outer housing (27), and a tip imaginary line (73) of a first part (39*a*) of the end face of the stepped part (35*a*) is curved so that a position of the end face (39*a*) of the stepped part (35*a*) corresponding to the joining portion (63) is located on a far side from the electric wire pullout opening (28) in the shell insertion direction (X) than a position of the end face (39*a*) of the stepped part (35*a*) corresponding to the bendable side portion (61), to thereby urge the cover plate portion (37) in a bending direction when the inner housing (31) is inserted into the outer housing (27).

(ii) The shield connector (100) according to the above (i), wherein the outer housing (27) has an inner circumferential seal surface (67) formed in the electric wire pullout opening (28) and configured to tightly contact with a seal outer circumferential surface (65) of a seal material (19) mounted on outer circumferences of the shield cable (25), a tip imaginary line (75) of a second part (39*b*) of the end face of the stepped part (35*b*) is straight, so that an insertion-direction seal end surface (77) of the seal material (19) abuts against the second part (39*b*) of the end face of the stepped part (35*b*), and the second part (39*b*) of the end face of the stepped part (35*b*) is disposed at both sides of the first part (39*a*) of the end face of the stepped part (35*a*).

(iii) The shield connector (100) according to the above (i) or (ii), wherein:

the stepped part (35, 35*a*, 35*b*) includes a plurality of ribs extending in the shell insertion direction (X) and provided in parallel to each other with intervals therebetween in an inner peripheral direction of the outer housing (27).

According to the shield connector of the invention, when the shield shell in which the inner housing has been accommodated is inserted into the outer housing, base end sides of the cover plate portions small in open amount (upward slanting amount) in the vicinities of the bendable side portions first abut against the electric wire pullout side end surfaces of the corresponding stepped parts. When the shield shell is further inserted into the outer housing, the insertion front end edges of the cover plate portions accommodate reaction force (urging force) from the electric wire pullout side end surfaces so that the cover plate portions can be bent in the bending direction. The tip imaginary line indicating positions of the electric wire pullout side end surfaces is curved to be gradually far toward the joining portions. Therefore, the cover plate portions are bent stepwise in accordance with the insertion of the shield shell into the outer housing. Finally, the insertion front end edges at the joining portions are bent by the corresponding electric wire pullout side end surfaces. As a result, the insertion front end edges at the joining portions, which are large in open amount, are not directly hooked by the stepped parts so that the shield shell can be inserted into the outer housing smoothly.

According to the shield connector of the invention, a space between each of the shield electric wires led out of the outer housing and the inner circumferential seal surface in the electric wire pullout opening of the outer housing can be sealed and water-proofed by the seal material. On this occasion, the insertion-direction seal end surface of the seal material can abut against the electric wire pullout side end surfaces of the other stepped parts whose tip imaginary line is straight. Thus, the seal material can be surely positioned and pressed in the shell insertion direction, thereby preventing deterioration in waterproof performance.

According to the shield connector of the invention, due to a gap present between adjacent ones of the ribs, a contact area between the outer housing and the shield shell when the shield shell is inserted can be smaller than that in the case where a stepped part is formed in a thick portion of the outer housing. Thus, insertion resistance can be suppressed so that insertion workability of the shield shell can be further enhanced. In addition, a resin material for forming the outer housing can be reduced. Thus, the outer housing can be lighter in weight.

According to the shield connector according to the invention, it is possible to secure assembling workability of the seal shell and waterproofness of the seal material.

What is claimed is:

1. A shield connector comprising:

an electric wire including a shield cable and a terminal which is provided at an end of the shield cable;

an inner housing configured to accommodate the terminal;

a shield shell formed with a terminal fitting opening and an electric wire pullout opening and including a cover plate portion configured to cover the inner housing;

an outer housing including an electric wire pullout opening and configured to accommodate the shield shell in a shell insertion direction along an electric wire extension direction; and a stepped part protruding from an inner wall of the outer housing so that a protruding tip of the stepped part supports the shield shell, wherein the cover plate portion is disposed between the terminal fitting opening and the electric wire pullout opening of the shield shell, and includes a bendable side portion extending along the shell insertion direction so that a joining portion of the cover plate portion extends along the shell insertion direction, an end face of the cover plate portion in the shell insertion direction is configured to come in contact with an end face of the stepped part at a side of the electric wire pullout opening in the shell insertion direction when the inner housing is inserted into the outer housing, and a tip imaginary line of a first part of the end face of the stepped part is curved so that a position of the end face of the stepped part corresponding to the joining portion is located on a far side from the electric wire pullout opening in the shell insertion direction than a position of the end face of the stepped part corresponding to the bendable side portion, to thereby urge the cover plate portion in a bending direction when the inner housing is inserted into the outer housing.

2. The shield connector according to claim 1, wherein the outer housing has an inner circumferential seal surface formed in the electric wire pullout opening and configured to tightly contact with a seal outer circumferential surface of a seal material mounted on outer circumferences of the shield electric wire, a tip imaginary line of a second part of the end face of the stepped part is straight, so that an insertion-direction seal end surface of the seal material abuts against the second part of the end face of the stepped part, and the second part of the end face of the stepped part is disposed at both sides of the first part of the end face of the stepped part.

3. The shield connector according to claim 1, wherein:

the stepped part includes a plurality of ribs extending in the shell insertion direction and provided in parallel to each other with intervals therebetween in an inner peripheral direction of the outer housing.

* * * * *